US007394441B2

(12) United States Patent
Lee

(10) Patent No.: US 7,394,441 B2
(45) Date of Patent: Jul. 1, 2008

(54) DATA DRIVE INTEGRATED CIRCUIT WITH REDUCED SIZE AND DISPLAY APPARATUS HAVING THE SAME

(75) Inventor: Jae-Hoon Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 115 days.

(21) Appl. No.: 11/269,293

(22) Filed: Nov. 8, 2005

(65) Prior Publication Data

US 2006/0125736 A1 Jun. 15, 2006

(30) Foreign Application Priority Data

Dec. 9, 2004 (KR) ..... 10-2004-0103524

(51) Int. Cl.
*G09G 3/30* (2006.01)
*G09G 3/10* (2006.01)

(52) U.S. Cl. ..... 345/76; 315/169.4

(58) Field of Classification Search ..... 315/169.1, 315/169.2, 169.3, 169.4; 345/45, 70, 76, 345/77, 84, 87
See application file for complete search history.

(56) References Cited

U.S. PATENT DOCUMENTS 5,585,816 A * 12/1996 Scheffer et al. ..... 345/100
5,604,510 A 2/1997 Blanchard
5,852,429 A * 12/1998 Scheffer et al. ..... 345/100
6,795,056 B2 * 9/2004 Norskog et al. ..... 345/158
2003/0128202 A1 7/2003 Kim et al. ..... 345/212
2006/0250334 A1 * 11/2006 Giraldo et al. ..... 345/82

FOREIGN PATENT DOCUMENTS

| | | |
|---|---|---|
| JP | 06-046360 | 2/1994 |
| JP | 2002-366076 | 12/2002 |
| JP | 2003-234655 | 8/2003 |
| KR | 10-0250422 | 1/2000 |
| KR | 100250422 | 1/2000 |
| KR | 10-2003-0002866 | 1/2003 |
| KR | 10-2003-0002897 | 1/2003 |
| KR | 10-2003-0060461 | 7/2003 |
| KR | 10-2004-0075628 A | 8/2004 |
| KR | 10-2005-0041076 | 5/2005 |

* cited by examiner

*Primary Examiner*—Douglas W. Owens
*Assistant Examiner*—Minh Dieu
(74) *Attorney, Agent, or Firm*—F. Chau & Assoc., LLC

(57) ABSTRACT

There is provided a display apparatus including a data drive IC. The data drive IC includes a current-mode analog to digital converter (DAC) comprising a plurality of dynamic circuits (instead of conventional level shifters). In response to an enable signal received, each of the dynamic circuits convert a bit of an image data signal received from a signal input circuit into a high voltage level and outputs the resulting signal to a current switch that outputs current to a current node connected to a pixel. The data drive IC including the dynamic circuit has reduced chip area and reduced power consumption (compared to conventional ones comprising a plurality of level-shifters).

29 Claims, 5 Drawing Sheets

DATA DRIVE INTEGRATED CIRCUIT WITH REDUCED SIZE AND DISPLAY APPARATUS HAVING THE SAME

BACKGROUND OF THE INVENTION

1. Field of the Invention

The present invention relates to a display apparatus, and more particularly, to an Organic Light Emitting Diode display apparatus driven by a current and a drive method therefore.

2. Description of the Related Art

Organic Light Emitting Diode technology enables full color, full-motion flat panel displays with a level of brightness and sharpness not possible with other technologies. Unlike traditional LCD's, OLED's are self-luminous and do not require backlighting, diffusers, polarizers, or any of the other baggage that goes with liquid crystal displays. An Organic Light Emitting Diode (OLED) device is basically a piece of glass with thin-film (silicon) transistors (TFTs) with a stack of (e.g., four or five) extremely thin layers of organic materials on top of that. When a current is conducted across that stack, the organic materials glow. This luminescent phenomenon of organic compounds was first discovered in anthracene crystals (a hydrocarbon) in 1963. In 1987, Ching Tang and Steven van Slyke at Eastman Kodak (Rochester, N.Y.) formed an ultra-thin bi-layer organic light emitting diode (OLED) device with improved luminescence efficiency and stability. In late 1997 a mono-color OLED display was commercialized by Pioneer. A 5.5" true-color OLED display was demonstrated by Sanyo-Kodak at the Society for Information Display (SID) meeting in 2000. And, in 2003 Kodak sold a digital camera that has the distinction of having been the first commercially available color OLED (organic light-emitting diode) display.

An OLED display can be driven at a lower driving current than other displays such as TFT-LCDs, PDPs, FEDs, and the like. Also, the OLED display is self-luminescent and thus exhibits high visibility. Moreover, the OLED display can have small display thickness because it does not need a backlight assembly unlike the TFT-LCD. Since the OLED display can provide a rapid response time and a wide viewing angle compared with current LCDs, it is considered as one of the next-generation flat panel displays capable of producing a high-quality moving image and a technology development for its commercialization is being actively pursued. The use of OLED displays as a display for small-sized information devices such as IMT2000, PDAs, Digital Cameras, video camera, multimedia devices and the like is rapidly increasing. OLED displays are expected to compete in the near future with the TFT-LDC in the markets of notebook computers and flat panel TVs. Because OLED production is more akin to chemical processing than semiconductor manufacturing, OLED materials could someday be applied to flexible plastic and other materials to create wall-size video panels, roll-up screens for laptops, and even wearable displays (e.g., clothes).

A data drive IC provided in an OLED display device drives a current through each pixel of an OLED panel.

FIG. 1 is a block diagram of a conventional OLED display apparatus.

Referring to FIG. 1, an OLED display device 10 receives an image data signal, a sync signal, and a clock signal from a host (not shown) and displays a color image on the OLED array.

The display device 10 includes a timing controller 100, a data drive integrated circuit (IC) 200, a voltage generator 300, a scan drive IC 400, and an OLED panel 500.

The timing controller 100 adjusts image data signals from the host to a timing required for the data drive IC 200 and the scan drive IC 400. Also, the timing controller 100 generates and outputs control signals for controlling the data drive IC 200 and the scan drive IC 400.

The voltage generator 300 provides voltages necessary for the display device 100. For example, the voltage generator 300 generates a power supply voltage (e.g., of 3.3V and 18V) for driving the data drive IC 200.

The OLED panel 500 includes data lines arranged to intersect a plurality of scan lines, and a plurality of pixels connected respectively to the scan lines and the data lines at their intersections. Each pixel includes an OLED (an organic light emitting diode).

In response to a control signal received from the timing controller 100, the scan drive IC 400 generates scan signals G0 through Gn for sequentially activating the scan lines. In this manner, all the scan lines of the OLED panel 500 are sequentially activated.

The data drive IC 200 receives image data signals DATA0 to DATAn from the timing controller 100, generates data line drive signals D0 to Dn corresponding to the received image data signals DATA0 to DATAn, and transfers the generated data line drive signals D0 to Dn through the data lines to the respective pixels.

FIG. 2 is a detailed circuit diagram of a conventional data drive IC.

Referring to FIG. 2, a data drive IC 200 includes a signal input circuit 210 and a plurality (n) of digital-to-analog converters (DACs) 220-0 to 220-n. The DACs 220-0 to 220-n correspond respectively to data lines D0 to Dn. All the DACs 220-0 to 220-n have the same circuit structure and operate in the same manner. Accordingly, only the DAC 220-0 corresponding to the first data line D0 will be illustrated and described for simplicity.

The DAC 220-0 includes level shifters 221 to 225, a step-current source circuit 230, a PMOS transistor 260, and an NMOS transistor 262. In response to each bit of an image data signal, for driving current on the data line D0, each of the level shifters 221 to 223 converts an image data signal of a power supply voltage (e.g., VDD) supplied from the signal input circuit 210 into an image data signal (e.g., DA0[0], DA0[1], . . . DA0[k-1] at a voltage level (VCCH) higher than the power supply voltage (VDD).

Base upon the driving method, the OLED matrix display can be classified as either a passive matrix or an active matrix display. Passive matrix displays adopt the method of driving the scan lines of the display in sequence, driving pixels in different rows sequentially. Active matrix displays, possess an independent pixel transistor for each pixel.

Since a passive matrix OLED display panel drives pixels by a line emission mode, it can reproduce an image of a desired brightness by instantaneously supplying a large current to the OLED pixel (e.g., by applying a high voltage (e.g., VCCH) across the OLED pixel). For example, the power supply voltage is 3.3V, and the high voltage VCCH is 18V. Therefore, the DAC 220-0 must be implemented by high-voltage devices (transistors).

The step-current source circuit 230 includes a current mirror comprising constant current source 232 and PMOS transistors 231, 241 to 24-k. The step-current source circuit 230 further includes current switching transistors 251, 252 through 25-k. The PMOS transistor 231 has a source connected to a high voltage VCCH (higher than the power supply voltage VDD), a drain and gate that are connected to the current sinking node of the constant current source 232.

Each of the PMOS transistors 241, 242 to 24-k operates as a resistor, and has its source commonly connected to the high voltage VCCH and its gate commonly connected to the gate and drain of the PMOS transistor 231. The PMOS transistors 241, 241 to 24-k are set to have different resistance values (e.g., 1R, 2R and 4R, respectively where R is a unit of resistance). The transistor 241 corresponding to the least significant bit LSB DAO[0] of the image data signal has the highest resistance value (e.g., 4R) an thus conducts the least step current (e.g., VCCH/4R), and the transistor 24-k corresponding to the most significant bit MSB DAO[k-1] of the image data signal has the lowest resistance value (e.g., 1R) an thus conducts the largest step current (e.g., VCCH/R).

By the above-structured step current source circuit 230, step (discretized) currents, corresponding to the level-shifted image data signals DO[0:k-1] from the level shifters 221 to 223, are supplied to the node N1.

The PMOS transistor 260 and the NMOS transistor 261 are serially connected between the step current source node N1 and the ground voltage. The gate of the PMOS transistor 260 is connected to an output enable signal OUTEN from the level shifter 224, and the gate of the NMOS transistor 261 is connected to a preset enable signal PSEN from the level shifter 225. A current at the common connection node between the transistors 260 and 261 is outputted as a first data line drive signal D0.

FIG. 3 is a detailed circuit diagram of the conventional level shifter 221 shown in FIG. 2. The level shifters 222 to 225 have the same circuit structure and operate in the same manner as the level shifter 221, and thus their detailed description will be omitted for simplicity.

Referring to FIG. 3, the level shifter 221 includes an inverter 271 (which may comprise two transistors) to generate a differential signal, cross coupled PMOS transistors 272 and 273, and NMOS differential input transistors 274 and 275. The PMOS transistor 272 and the NMOS transistor 274 are serially connected between the high voltage VCCH and the ground voltage, and the PMOS transistor 273 and the NMOS transistor 275 are serially connected between the high voltage VCCH and the ground voltage. The gate of the PMOS transistor 272 is connected to the gate of the NMOS transistor, and the gate of the PMOS transistor 273 is connected to the drain of the NMOS transistor 274. The voltage at a connection node between the PMOS transistor 273 and the NMOS transistor 275 is outputted as an image data signal DA0[0] that is an inputted image data signal DATA0[0] shifted into a high voltage level VCCH.

As described above, in the conventional level shifter 221, signals DATA0[0] and nDATA0[0] applied to the gates of the NMOS transistors 274 and 275 are at a power supply voltage level VDD, and the voltage applied to the gates of the PMOS transistors 272 and 273 is at a high voltage level VCCH (higher than the power supply voltage VDD). Therefore, for an exact level shift operation and an improved switching operation speed, the NMOS transistors 274 and 275 are designed to have a larger (channel) width than the PMOS transistors 272 and 273. For example, when voltage at the of one of the PMOS transistors 272 and 273 is 20V and the voltage at the gate of one of the NMOS transistors 274 and 275 is 2.2V, the NMOS transistors 274 and 275 must have more than six times the width of the PMOS transistors 272 and 273.

Referring again to FIG. 2, when a 6-bit image data signal is inputted for driving each data line D0, the binary-weighted type DAC needs 1, 2, 4, 8, 16 and 32 unit resistor transistors for six respective bits, that is, a total of 63 units or resistance in the transistors. Thus, the binary-weighted type DAC needs 63 level shifters.

By contrast, a 6-bit segment-type DAC needs a total of 10 level shifters (six for implementing resistors of 1R, 2R, 4R, 8R, 16R and 32R) plus transistors 260 and 261. As well known in the art, the 6-bit segment-type DAC least significant bit is configured to have a binary-weighted type DAC for processing LSB (least significant bit) 3 bits and a thermometer-type DAC for processing MSB (most significant bit) 3 bits. The binary-weighted type DAC for the LSB 3 bits includes three resistor transistors having ¼ times, ½ times and 1 times the size of the unit resistor transistor, respectively. The thermometer-type DAC for the MSB 3 bits includes seven resistor transistors each having ½ times the size of the unit resistor transistor. Consequently, the 6-bit segment-type DAC needs a total of ten resistor transistors classified into four types. Accordingly, ten level shifters are required.

Since a GVGA display device uses 240 data lines, a GVGA display having 6-bit segment-type DACs needs at least 2400 (240*10) level shifters. It is very burdensome to fabricate and fit 2400 level shifters 221 in the data drive IC 200 illustrated in FIG. 3.

Also, the transistor 260 illustrated in FIG. 2 must be big (wide in its channel) enough to fully transfer the full current from the node N1 as the data line drive signal D0. These big transistors cause an increase in power consumption.

SUMMARY OF THE INVENTION

Embodiments of the present invention provide a data drive IC having a reduced size, and reduced power consumption, (relative to the data drive IC 200 of FIG. 2).

Additional features of the invention will be set forth in the description that follows, and others will be apparent to those having ordinary skill in the art upon examination of the following or may be learned from practice of the invention. The invention may be implemented using the structure particularly pointed out in the written description and the appended drawings, or in other embodiments within the claims hereof.

In an aspect of the present invention, there is provided a display apparatus including: a pixel; a current source circuit for supplying, to a pixel, a current having a magnitude corresponding to a current control signal to the pixel; and an current control circuit for generating the current control signal so as to disable the current source circuit (e.g., resetting the magnitude of the current to zero) during a first (precharging) phase period, and generating the current control signal so as to supply a current having a magnitude corresponding to a received image data signal during a second (level-shifting) phase period.

The current control circuit may precharge the current control signal to a first voltage (e.g., VCCH) during the first phase period.

The current control circuit may selectively discharge (each bit of) the current control signal according to the (bits of the) received image data signal during the second phase period.

An aspect of the invention provides a Digital-to-Analog Converter (DAC), comprising: a current source circuit (including a plurality of resistors (e.g., fixed transistors) each corresponding to one bit of a digital current control signal; and a plurality of current switches (e.g., PFET transistors), each connected in series with a corresponding one of the resistors, between a first voltage (e.g., VCCH) and current output node, and having its gate connected to a corresponding bit of the digital current control signal); and a current control circuit (including a plurality of dynamic gate circuits each configured to receive a corresponding bit of a digital data signal, and to output a corresponding bit of the digital current control signal in response to an enable signal). Each of the dynamic gate circuits of the current control circuit comprises fourth, fifth and sixth switches (.e.g., transistors) serially connected between the first voltage and a second (e.g., ground) voltage, the fourth and sixth switches each having a gate connected to the enable signal (EN), the fifth switch having a gate connected to a corresponding bit of the digital data signal.

The current source circuit may include: a first transistor (acting as a resistor of predetermined resistance) having one end connected to the first voltage; and a second transistor (for current switching) having one end connected to another end of the first transistor, another end connected to the pixel, and a gate connected to the current control signal.

The current control circuit may include: an enable control circuit for generating an enable signal indicating the first (precharging) phase and the second (level-shifting) phase; and a dynamic gate circuit for receiving the image data signal in response to the enable signal (EN) and outputting the current control signal.

The dynamic gate circuit may include fourth, fifth and sixth transistors serially connected between the first voltage and a second (e.g., ground) voltage, the fourth and sixth transistors each having a gate connected to the enable signal, the fifth transistor having a gate connected to the image data signal. The fourth and fifth transistors may have a connection node therebetween for outputting a voltage thereof as the current control signal. The fourth, fifth and sixth transistors may have the same size.

The enable signal may be active at the first voltage level, and the enable control circuit may include a (conventional) level shifter for converting a precharge signal at a power supply voltage level into the first voltage level. The first voltage may be higher than a power supply voltage.

The apparatus may further include a discharge circuit (e.g., an NFET transistor switchably connecting the data line of the pixel to ground) for discharging the pixel before the current source circuit supplies the current to the pixel. The pixel may be an OLED device.

In another aspect of the present invention, there is provided a display apparatus including a plurality of pixels; and a plurality of DACs, the DACs each including: a (step) current source circuit for supplying (to the corresponding pixel) a current corresponding to a current control signal; and an current control circuit for generating the current control signal so as to disable the current source circuit (e.g., zero the magnitude of the current) during a first (precharging) phase period, and generating the current control signal so as to supply a current (at a magnitude) corresponding to a received image data signal during a second (level-shifting) phase period.

The image data signal and the current control signal may each include a plurality (e.g., the same number, e.g., k) of bits corresponding to one another.

The current control circuit may precharge each bit (line) of the current control signal to a first voltage during the first phase period, and may selectively discharge each bit of the current control signal according to a corresponding bit of the received image data signal during the second phase period.

The current source circuit may include: a plurality of first transistors (functioning as a resistor) each corresponding to each bit of the current control signal and having one end connected to the first voltage and; and a plurality of second transistors (for current switching) each having one end connected to another end of the corresponding first transistor, another end connected to the pixel, and a gate connected to a corresponding bit of the current control signal.

The current control circuit may include: an enable control circuit (e.g., comprising a conventional level-shifter) for generating an enable signal (EN) indicating the first phase and the second phase; and a plurality of dynamic gate circuits each corresponding to one bit of the image data signal, receiving a corresponding bit of the image data signal and outputting a corresponding bit of the current control signal in response to the enable signal.

The dynamic gate circuits each may include fourth, fifth and sixth transistors serially connected between the first voltage and a second (e.g., ground) voltage, the fourth and sixth transistors each having a gate connected to the enable signal, the fifth transistor having a gate connected to a corresponding bit of the image data signal. The fourth and fifth transistors may have a connection node therebetween for outputting (a voltage as) a corresponding bit of the current control signal.

The fourth, fifth and sixth transistors may have the same size. The enable signal may asserted at the first voltage level, and the enable control circuit may include a (conventional) level shifter for converting a precharge signal at a power supply voltage level into the first voltage level. The first voltage may be higher than the power supply voltage.

The apparatus may further include a discharge circuit (e.g., NFET transistor) for discharging the pixel before the current source circuit supplies the current to the pixel.

In a still further another aspect of the. present invention, there is provided a method for controlling a display apparatus including a current source circuit for supplying a current corresponding to a current control signal to a pixel, the method including the steps of: a) generating the current control signal so as to disable the current source circuit (e.g., to zero the magnitude of the current); and b) generating the current control signal so as to supply a current having a magnitude corresponding to a received image data signal to the pixel.

The step a) may include the step of pre-charging the current control signal to a first voltage, and the step b) may include the step of selectively discharging the bits of the current control signal according to the bits of the received image data signal.

It is to be understood that both the foregoing summary description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. Reference will now be made in detail to the preferred embodiments of the present invention, examples of which are illustrated in the accompanying drawings. However, the present invention is not limited to the embodiments illustrated herein after, and the embodiments herein are rather introduced to provide easy and complete understanding of the scope and spirit of the present invention. In the drawings.

DETAILED DESCRIPTION OF THE INVENTION

Figure 4:
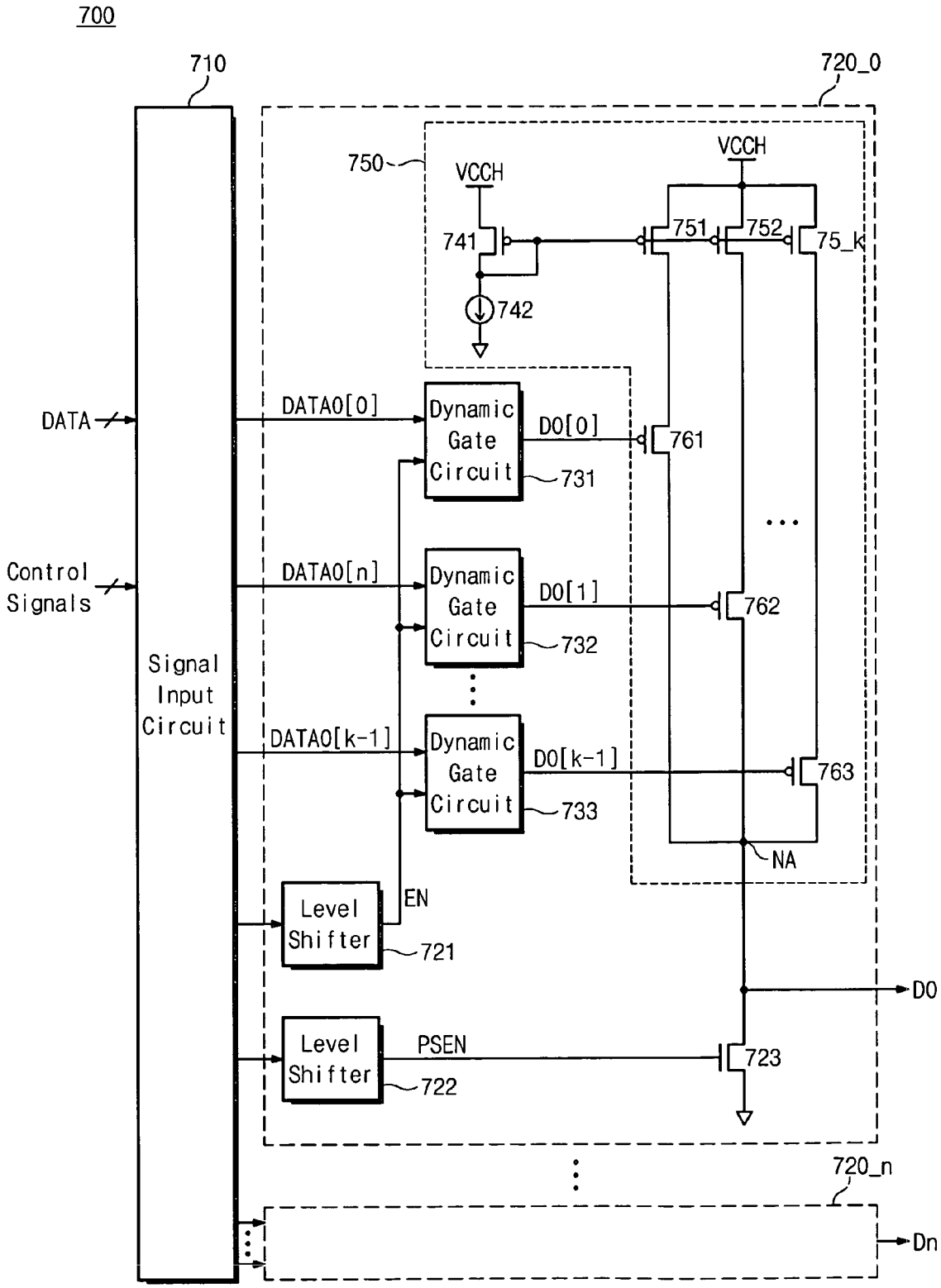
FIG. 4 is a detailed circuit diagram of a data drive IC according to an embodiment of the present invention.

FIG. 4 is a detailed circuit diagram of a data drive IC according to an embodiment of the present invention.

Referring to FIG. 4, a data drive IC 700 includes a signal input circuit 710 and a plurality (m, where m=n+1) of DACs 720 (e.g., 720-0 to 720-n).

The DACs 720-0 to 720-n correspond respectively to data lines D0 to Dn. All m of the DACs 720-0 to 720-n have the same circuit structure and operate in the same manner. Accordingly, for simplicity, only the DAC 720-0 corresponding to the first data line D0 will be illustrated and described.

The DAC 720-0 includes, a step current source circuit 750, a current control circuit (comprised of level shifters 721 and 722, and of dynamic gate circuits 731 to 733) and a data line discharging transistor (NMOS transistor 723). In response to a control signal received from the signal input circuit 710, the level shifter 721 generates and outputs an enable signal EN for enabling all of the dynamic gate circuits 731 to 733 of the DAC 720. In response to a control signal received from the signal input circuit 710, the level shifter 722 generates and outputs a preset enable signal PSEN for controlling the NMOS transistor 723. Control signals outputted from the signal input circuit 710 are generated at either the ground voltage level or at the supply power voltage level VDD), and Control signals outputted from the level shifters 721 and 722 are generated at the ground voltage level or at the high voltage level VCCH.

The dynamic gate circuits 731 to 733 each correspond to one bit of an image data signal supplied from the signal input circuit 710, and converts the voltage level of an image data signal (e.g., DATA0[0]) supplied from the signal input circuit 710. Each of the dynamic gate circuits 731, 732 and 733 functions as a voltage level shifter during an operational phase when the logic high level of the input voltage signal DATA[O] is applied at a supply voltage level VDD and a capacitance of the output line (carrying image data signal DA0[0]) is precharged at a voltage VCCH higher than the supply voltage level VDD. The capacitance of the output line (carrying image data signal DA0[0]) may be a parasitic line capacitance or an explicit capacitor connected thereto. The output line DA0[0] may be precharged during a precharge phase to the voltage higher than the supply voltage level VDD through transistor 771 if the stack voltage VCCH is at the voltage higher than the supply voltage level VDD.

The step current source circuit 750 includes a constant current source 742 and a current mirror comprised of PMOS transistors 741, 751 to 75-k) plus current switching PMOS transistors 761 to 76-k. The PMOS transistor 741 has a source connected to the high voltage VCCH (higher than the power supply voltage VDD), a drain and gate that are connected to the current sinking node of the constant current source 742. For example, the high voltage VCCH is 18V higher than the power supply voltage VCC. Because the voltage at the gates of PMOS transistors 751 to 75-k is fixed (does not change dynamically), each of the PMOS transistors 751 to 75-k operates as a resistor, and has a source connected to the high voltage VCCH and a gate commonly connected to the gate and drain of the PMOS transistor 741. The PMOS transistors 751 to 75-k are designed to have different resistance values (e.g., 1R, 2R, 4R, etc. where R is unit of resistance), and correspond respectively to the bits of the image data signal. The transistor 751 (corresponding to the least significant bit LSB D0[0] of the image data signal) has the highest resistance value, and the transistor 75-k (corresponding to the most significant bit MSB D0[k-1] of the image data signal) has the lowest resistance value (e.g., 1R).

Each of the PMOS current switching transistors 761 to 76-k has a source respectively connected to the drain of the corresponding one of resistor transistors 751 to 75-k, and a drain commonly connected to a node NA, and a gate controlled by one of the image data signals (e.g., DATA0[0], DATA0[1] . . . DATA0[k-1]) received from the corresponding one of dynamic gate circuits 731 to 733. Accordingly, the PMOS transistors 761 to 76-k each serve as a switching transistor for switchably conducting a current driven by the corresponding one of resistor transistors 751 to 75-k to the node NA, in response to a bit of the corresponding image data signal.

By the above-structured step current source circuit 750, a current having a level corresponding to the level-shifted image data signals D0[0:k-1] from the level shifter 721 to 722 are applied to the node NA.

The NMOS transistor 723 is connected between the node NA and the ground voltage, and has a gate connected to the preset enable signal PSEN outputted from the level shifter 722. The NMOS transistor 723 is controlled so that the current supplied through the PFET transistors of the step current source circuit 750 the node NA is outputted as a data line drive signal D0 and does not pass to ground through the NMOS transistor 723.

The preset enable signal PSEN is momentarily activated before the enable signal EN to discharge the data line drive signal D0 to the ground voltage level. This momentary activation of NMOS transistor 723 discharges the previous data line drive signal D0 that was charged to a specific level by the previous image data signal.

In response to the enable signal EN from the level shifter 721, the dynamic gate circuits 731 to 733 convert the image data from the signal input circuit 710 into a low level.

Figure 5:
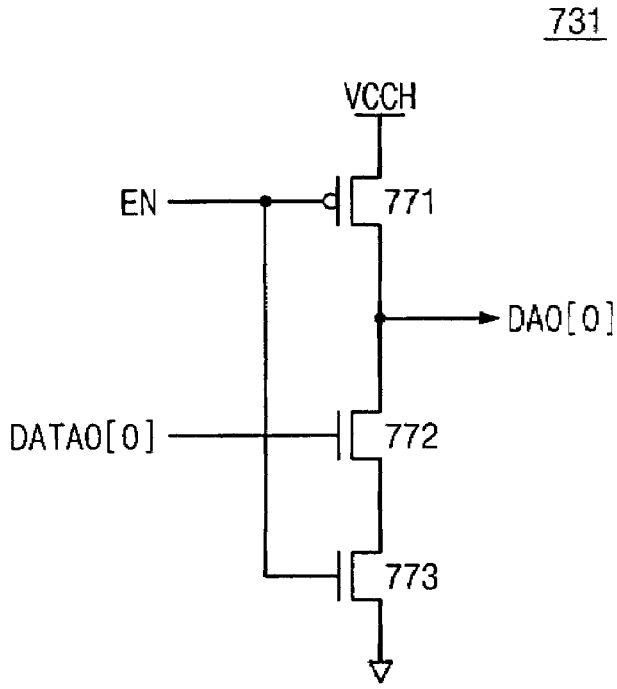
FIG. 5 is a detailed circuit diagram of a dynamic gate circuit (e.g., level shifter) according to an embodiment of the present invention.

FIG. 5 is a detailed circuit diagram of the dynamic gate circuit 731 shown in FIG. 4 according to an embodiment of the present invention. The dynamic gate circuits 732 to 733 have the same circuit structure and operate in the same manner as the dynamic gate circuit 731, and thus their detailed description will be omitted for simplicity.

Referring to FIG. 5, the dynamic gate circuit 731 includes a PMOS transistor 771 and NMOS transistors 772 and 773 that are serially connected between the high voltage VCCH and the ground voltage. The gates of the transistors 771 and 773 are connected to the enable signal EN from the level shifter 721, and the gate of the NMOS transistor 772 is connected to a corresponding image data signal DATA[0] from the signal input circuit 710 (FIG. 4).

Figure 6:
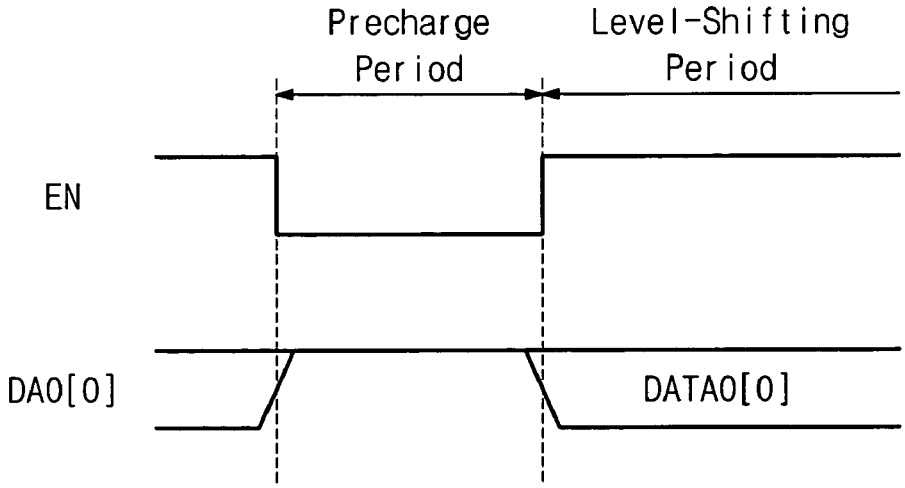
FIG. 6 is a timing diagram illustrating the relationship between an enable signal and an image data signal, (i.e., I/O signals) of the dynamic gate circuit shown in FIG. 5.

FIG. 6 is a timing diagram illustrating the relationship between the enable signal EN and the image data signal D0[0], (i.e., the input and output signals of the dynamic gate circuit 731 of FIG. 5). The enable signal EN is at a low level during a precharge period. During the precharge period this time, the PMOS transistor 771 (FIG. 5) is turned ON and the NMOS transistor 773 is turned OFF, and thus the image data signal DO[0] is precharged to a high level (i.e., VCCH).

During an level-shifting period, the enable signal EN is at a high level. During the level-shifting period, the PMOS transistor 771 (FIG. 5) is turned OFF and the NMOS transistor 773 is turned ON, and thus the image data signal DAO[0] is determined by the image data signal DATA0[0]. Here, the image data signal DATA0[0] from the signal input circuit 710 is at either the ground voltage level or at the supply power voltage level VDD, and consequently the image data signal DA0[0] from the dynamic gate circuit 731 is at either the ground voltage level or at the high voltage level VCCH.

The dynamic gate circuit 731 (FIG. 5) precharges the data line drive signal D0 to a high level VCCH and then outputs the image data signal DA0[0] corresponding to the inputted image data signal DATA0[0]. Accordingly, the transistors 771, 772 and 773 may have the same size.

Referring back to FIG. 4, when during the precharge period the level-shifted image data signals D0[0:k-1] are all in a high level, the switching transistors 761 to 75-k are all tuned ON. When the level-shifted image data signals D0[0:k-1] corresponding to the image data signals DATA0[0:k-1] are outputted through the dynamic gate circuits (e.g., 731, 732, and 733) during the level-shifting period, currents corresponding to the level-shifted image data signals D0[0:k-1] are passed through the current switching transistors (e.g., 761 to 76-k) to the node NA.

Figure 1:
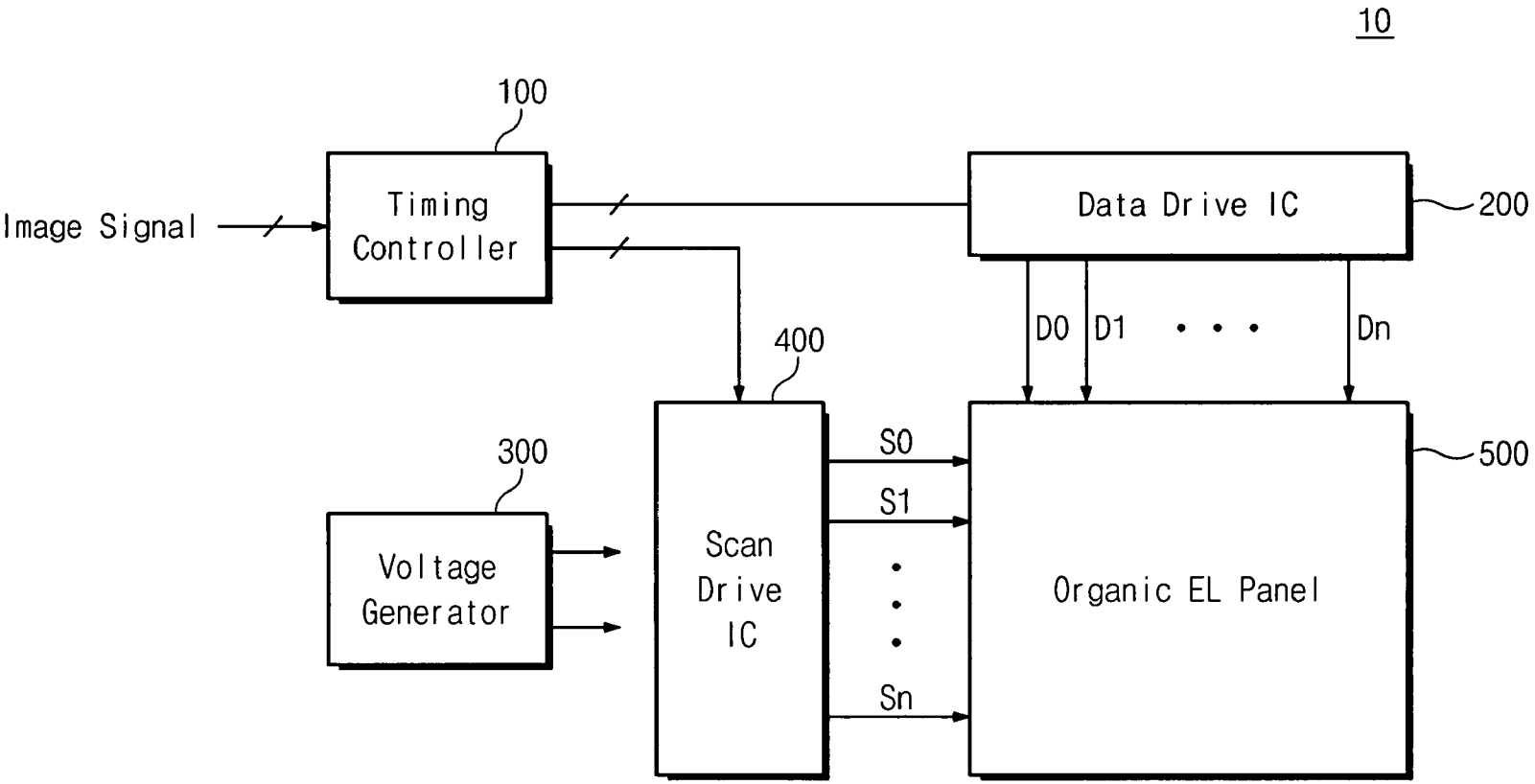
FIG. 1 is a block diagram of a typical OLED display apparatus.
Figure 2:
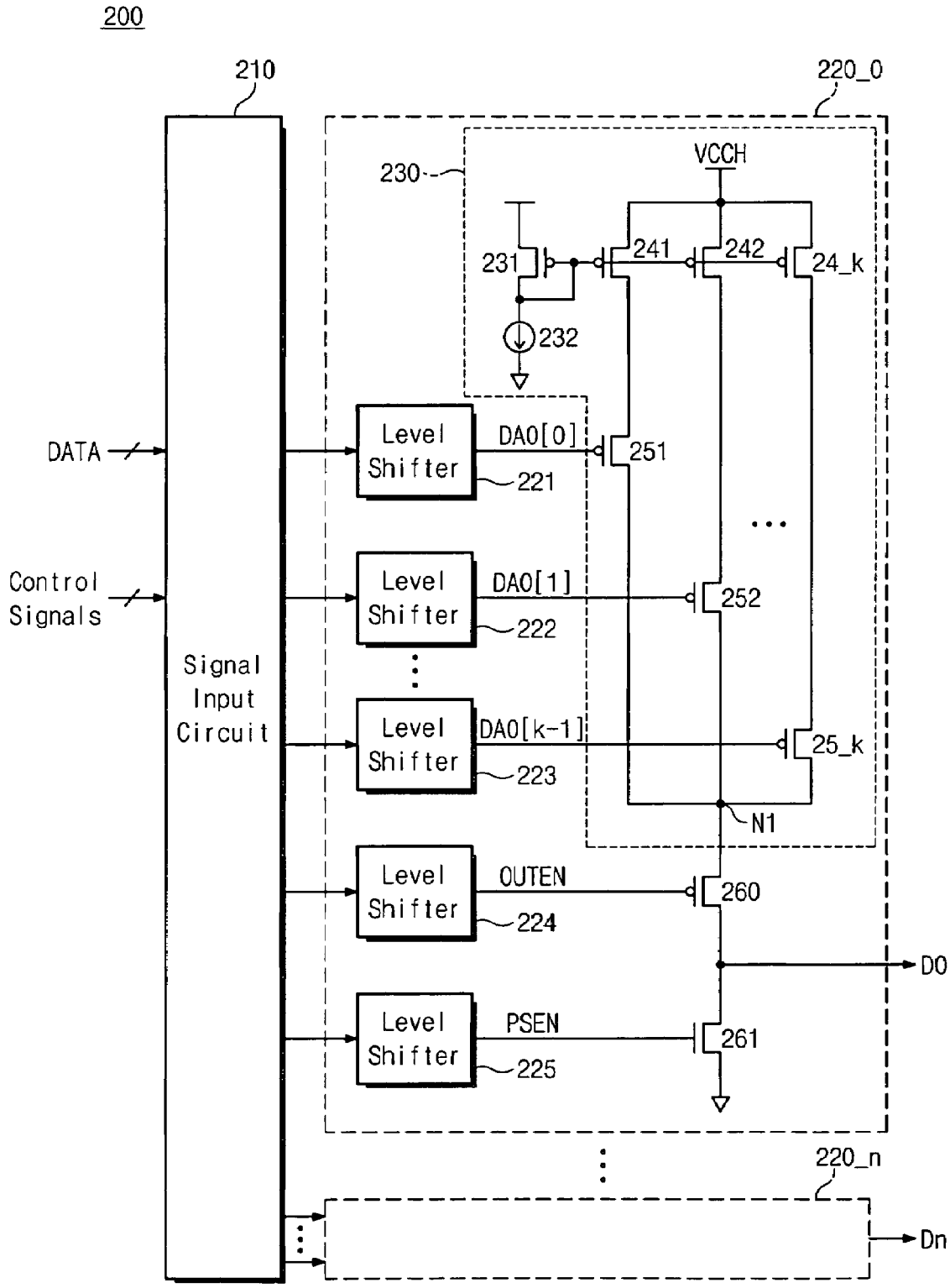
Fig. 2 (PRIOR ART)
FIG. 2 is a detailed circuit diagram of a conventional data drive IC.
Figure 3:
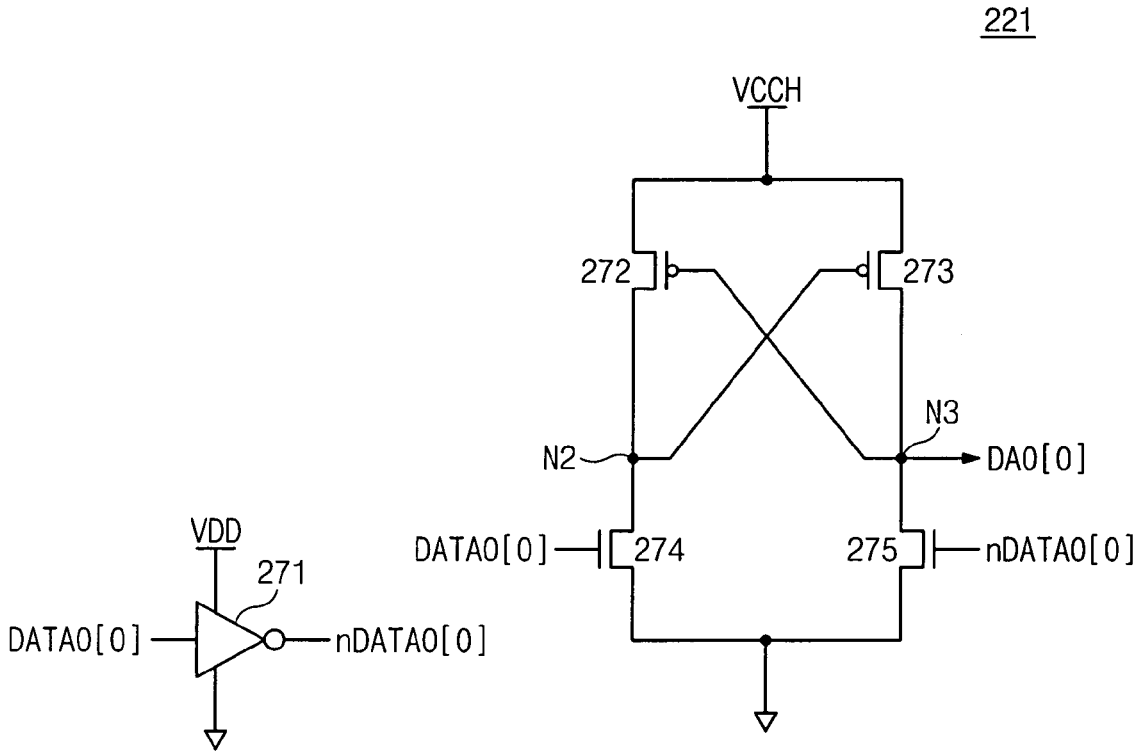
Fig. 3 (PRIOR ART)
FIG. 3 is a detailed circuit diagram of the conventional level shifter 221 shown in FIG. 2.

The inventive data drive IC 700 considerably reduces the number of conventional level shifters required for each data line as compared to the conventional art (FIGS. 2 & 3). Thus, the inventive data drive IC 700 may use only two conventional level shifters 721 and 722 for each data line, (e.g., one to drive the enable signal EN and one to drive the preset enable signal PSEN), while the conventional data drive IC 200 uses many (e.g., 2+k, for converting k DATA bits) conventional level shifters (e.g., two conventional level shifters, plus one conventional level shifter for each of the number of k bits), for driving the data line.

As described above, the inventive data drive IC 700 occupies a reduced area on a chip and has reduced power consumption.

It will be apparent to those skilled in the art that various modifications and variations can be made in the present invention. For example, the arrangement of the three stacked (series-connected) transistors 771, 772 and 773 within the dynamic gate circuit 731 (FIG. 5), may be modified. For example, the positions of NFET transistors 772 and 773 may be switched, without affecting the operation of the level shifter 731. Alternatively, a complementary dynamic gate circuit having complementary operations, inputs, and outputs may be comprised of a stack of two PFET transistors (gated by enable signal EN and image data signal DATAJ and one NFET transistor (gated by enable signal EN) connected in series. Thus, it is intended that the present invention covers the modifications and variations of this invention that come within the scope of the appended claims and their equivalents.

What is claimed is:

1. A display apparatus comprising:

a pixel;

a current source circuit configured to supply a current having a magnitude corresponding to a current control signal to the pixel; and a current control circuit receiving an image data signal for display and configured to generate the current control signal so as to disable the current source circuit during a first phase period, and generating the current control signal so as to supply the current having a magnitude corresponding to the received image data signal to the pixel during a second phase period.

2. The apparatus of claim 1, wherein the current control circuit precharges the current control signal to a first voltage during the first phase period.

3. The apparatus of claim 2, wherein the current control circuit selectively discharges the current control signal according to the received image data signal during the second phase period.

4. The apparatus of claim 3, wherein the current source circuit comprises:

a first transistor having one end connected to the first voltage; and a second transistor connected in series with the first transistor between the first voltage and a second voltage, and having one end connected to the pixel, and having a gate connected to the current control signal.

5. The apparatus of claim 4, wherein the current control circuit comprises:

an enable control circuit configured to generate an enable signal indicating the first phase and the second phase; and a dynamic gate circuit configured to receive the image data signal and the enable signal, and to output the current control signal in response thereto.

6. The apparatus of claim 5, wherein the dynamic gate circuit comprises fourth, fifth and sixth transistors serially connected between the first voltage and a second voltage, the fourth and sixth transistors each having a gate connected to the enable signal, the fifth transistor having a gate connected to the image data signal, and two of the fourth fifth, and sixth transistors having a connection node therebetween for outputting a voltage thereof as the current control signal.

7. The apparatus of claim 6, wherein the fourth and fifth transistors have a connection node therebetween for outputting a voltage thereof as the image control signal.

8. The apparatus of claim 6, wherein the second voltage is a ground voltage.

9. The apparatus of claim 6, wherein the fourth, fifth and sixth transistors have the same size.

10. The apparatus of claim 9, wherein the enable signal is active at the first voltage.

11. The apparatus of claim 10, wherein the enable control circuit comprises a level shifter configured to shift the voltage of a precharge signal from a power supply voltage to the first voltage.

12. The apparatus of claim 10, wherein the first voltage is higher than the power supply voltage.

13. The apparatus of claim 6, wherein the fourth transistor is a PFET transistor, and the sixth transistor is an NFET transistor.

14. The apparatus of claim 1, further comprising a discharge circuit configured to discharge the pixel before the current source circuit supplies the current to the pixel.

15. The apparatus of claim 1, wherein the pixel is an OLED electroluminescence device.

16. A display apparatus comprising:

a plurality of pixels; and a plurality of digital to analog converters (DACs), wherein each of the DACs includes:

a current source circuit configured to supply a current having a magnitude corresponding to a current control signal of the corresponding pixel; and an current control circuit configured to generate the current control signal so as to zero the magnitude of the current during a first phase period, and generating the current control signal so as to supply a current having a magnitude corresponding to a received image data signal of the corresponding pixel during a second phase period.

17. The apparatus of claim 16, wherein the image data signal comprises a plurality of bits and the current control signal comprises a plurality of corresponding bits.

18. The apparatus of claim 17, wherein the current control circuit resets each bit of the current control signal to a power supply voltage level during the first phase period.

19. The apparatus of claim 18, wherein the current control circuit selectively sets each bit of the current control signal according to a corresponding bit of the received image data signal during the second phase period.

20. The apparatus of claim 19, wherein the current source circuit comprises:

a plurality of first transistors, each corresponding to a bit of the current control signal and having one end connected to the first voltage and; and a plurality of second transistors, each second transistor being connected in series with a first transistor between the first transistor and a second voltage and having an end connected to a pixel, and having a gate connected to a corresponding bit of the current control signal.

21. The apparatus of claim 20, wherein the current control circuit comprises:

an enable control circuit configured to generate an enable signal indicating the first phase and the second phase; and a plurality of dynamic gate circuits each corresponding to each bit of the image data signal, receiving a corresponding bit of the image data signal and the enable signal and outputting a corresponding bit of the current control signal in response thereto.

22. The apparatus of claim 21, wherein each of the dynamic gate circuits comprises fourth, fifth and sixth transistors serially connected between the first voltage and a second voltage, the fourth and sixth transistors each having a gate connected to the enable signal, the fifth transistor having a gate connected to a corresponding bit of the image data signal, and the fifth transistor having drain connected to a node for outputting a corresponding bit of the current control signal.

23. The apparatus of claim 22, wherein the second voltage is a ground voltage.

24. The apparatus of claim 22, wherein the fourth, fifth and sixth transistors have the same size.

25. The apparatus of claim 24, wherein the enable signal is active at the first voltage level.

26. The apparatus of claim 25, wherein the enable control circuit comprises a level shifter configured to convert a precharge signal at a power supply voltage level into the first voltage level.

27. The apparatus of claim 26, wherein the first voltage is higher than the power supply voltage.

28. The apparatus of claim 16, further comprising a discharge circuit configured to discharge the pixel before the current source circuit supplies the current to the pixel.

29. The apparatus of claim 16, wherein the pixel is an OLED electroluminescence device.

* * * * *